United States Patent [19]

Shaub et al.

[11] Patent Number: 4,459,223

[45] Date of Patent: Jul. 10, 1984

[54] LUBRICANT OIL COMPOSITION WITH IMPROVED FRICTION REDUCING PROPERTIES

[75] Inventors: Harold Shaub, Berkeley Heights, N.J.; David I. Devore, Langhorne, Pa.; Kenneth S. Kirschenbaum, Westfield, N.J.

[73] Assignee: Exxon Research and Engineering Co., Florham Park, N.J.

[21] Appl. No.: 374,979

[22] Filed: May 5, 1982

[51] Int. Cl.[3] ..... C10M 1/26

[52] U.S. Cl. ..... 252/51.5 R; 252/56 R

[58] Field of Search ..... 252/56 R, 51.5 A, 51.5 R

[56] References Cited

U.S. PATENT DOCUMENTS

| | | | |
|---|---|---|---|
| 3,180,832 | 4/1965 | Furey | 252/56 R |
| 3,223,635 | 12/1965 | Dwyer et al. | 252/56 R |
| 4,388,201 | 6/1983 | Brownawell et al. | 252/56 R |

*Primary Examiner*—Jacqueline V. Howard

*Attorney, Agent, or Firm*—Eugene Zagarella

[57] ABSTRACT

A lubricating oil composition having improved friction reducing properties and the method of reducing friction in internal combustion engines by lubricating said engines with said lubricating oil which contains an effective friction reducing amount of an additive which is the reaction product of a dimer carboxylic acid and a polyhydric alcohol having at least three hydroxyl groups.

11 Claims, No Drawings

LUBRICANT OIL COMPOSITION WITH IMPROVED FRICTION REDUCING PROPERTIES

BACKGROUND OF THE INVENTION

This invention relates to a lubricating oil composition having improved friction reducing properties and to a method for reducing friction in internal combustion engines.

There has been considerable effort in recent years to improve the fuel economy of automotive engines which operate on petroleum fuel, a product which like other forms of energy has become very expensive. Some of the known ways to improve fuel economy have been of a mechanical or design nature, such as building smaller cars and engines. Since it is known that high engine friction causes significant energy loss, another way to improve fuel economy of automotive engines is to reduce such friction.

Major efforts to reduce friction in automotive engines have involved the lubricating oils used in such engines. One approach has been to use synthetic ester base oils which are generally expensive. Another approach has been to use additives to improve the friction properties of the lubricating oil. Among the friction reducing additives which have been used are a number of molybdenum compounds including insoluble molybdenum sulfides, and organo molybdenum complexes e.g. molybdenum amine complexes disclosed in U.S. Pat. No. 4,164,473, molybdenum thio-bis-phenol complexes disclosed in U.S. Pat. Nos. 4,192,753, 4,201,683 and 4,248,720, molybdenum oxazoline complexes disclosed in U.S. Pat. No. 4,176,074 and molybdenum lactone oxazoline complexes disclosed in U.S. Pat. No. 4,176,073.

Another group of friction reducing additives which have been used in lubricating oils are the carboxylic acid esters. These compounds include the esters of fatty acid dimers and glycols as disclosed in U.S. Pat. No. 4,105,571, the esters of monocarboxylic acids and glycerol as disclosed in U.S. Pat. No. 4,304,678, the ester of dimer acids and monohydric alcohol disclosed in U.S. Pat. No. 4,167,486, the esters of glycerol and monocarboxylic fatty acids as disclosed in U.K. Pat. Nos. 2,038,355 and 2.038,356, and esters of monocarboxylic fatty acids and polyhydric alcohols disclosed in U.S. Pat. No. 3,933,659.

While the different approaches described above all generally provide some reduced engine friction and consequently improved fuel economy, there is always the need and desire for further reductions in energy losses due to friction or otherwise, since even somewhat small reductions per individual engine can result in rather significant fuel savings, particularly when considering the total number of engines in use.

SUMMARY OF THE INVENTION

Now, it has surprisingly been discovered that lubricating oil compositions containing an additive of a selected reaction product of a dimer carboxylic acid and a polyhydric alcohol which contains at least three hydroxyl groups has significantly improved friction reducing properties.

More particularly, this invention is directed to a lubricating oil composition having improved friction reducing properties comprising a major amount of lubricating base oil and from about 0.01 to about 2.0 parts by weight of a reaction product of a dimer carboxylic acid having about 24 to about 90 carbon atoms with about 9 to about 42 carbon atoms between carboxylic acid groups and a polyhydric alcohol having at least three hydroxyl groups and from about 3 to about 18 carbon atoms, said reaction product being formed using from about 1 to about 3 moles of alcohol per mole of dimer acid.

Another embodiment of this invention relates to a method of reducing friction in an internal combustion engine by lubricating said engine using a lubricating oil composition containing an effective friction reducing amount of an additive which is the reaction product of a dimer carboxylic acid and a polyhydric alcohol having at least three hydroxyl groups.

DETAILED DESCRIPTION OF THE INVENTION

This invention is directed to a lubricating oil composition containing a selected additive reaction product to provide improved friction reducing properties and to a method of reducing friction in an internal combustion engine by using a lubricating oil composition which contains said additive reaction product.

The friction reducing additive which is used in this invention is an oil soluble reaction product of a dimer carboxylic acid and a polyhydric alcohol. Such a reaction product may be a partial, di- or polyester with typical formulas represented as follows when using a trihydric alcohol:

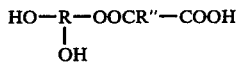

(1)

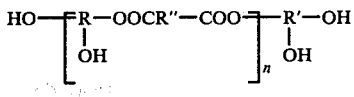

(2)

wherein R″ is the hydrocarbon radical of the dimer acid, each R and R′ may be the same or different hydrocarbon radicals associated with a trihydric alcohol and n is an integer which typically is 1 to 5 or higher. It will, of course, be appreciated that the ester reaction products can be obtained by reacting a dimer carboxylic acid or a mixture of such acids with a trihydric alcohol or other polyhydric alcohol or mixtures of such alcohols.

The carboxylic acid used in preparing the friction reducing reaction product of this invention will be a dimer of an aliphatic saturated or unsaturated carboxylic acid, said dimer acid having a total of about 24 to about 90 carbon atoms, and from about 9 to about 42 carbon atoms between the carboxylic acid groups. Preferably, the dimer acid will have a total of about 24 to about 60 carbon atoms and about 12 to about 42 carbon atoms between the carboxylic acid groups, and more preferably, a total of about 24 to about 44 carbon atoms and about 16 to about 22 carbon atoms between the carboxylic acid groups.

The alcohol used in preparing the friction reducing reaction product additive of this invention is a polyhydric alcohol having at least three hydroxyl groups and from about 3 to about 18 carbon atoms. Generally, such compounds will be aliphatic and may contain branched or unbranched hydrocarbon groups as well as other functional groups such as nitrogen, sulfur and phosphorus. Such polyhydric alcohols will contain at least three hydroxyl groups and may contain more, generally from three to six hydroxyl groups with the upper amount limited by the degree of solubility and effectiveness of the reaction product in the lubricating oil composition. Preferably, such polyhydric alcohol will contain about 3 or 4 hydroxyl groups and about 3 to about 12 carbon atoms. More preferably, such polyhydric alcohol will be saturated, contain 3 hydroxyl groups and about 3 to about 8 carbon atoms. Compounds of this type include glycerol (i.e., 1,2,3 propane triol), 1,2,6-trihydroxyhexane and 2,2',2" nitrilotriethanol.

The molar quantities of the dimer acid and polyhydric alcohol reactants may be adjusted so as to secure either a complete ester or partial ester and generally from about 1 to about 3 or more moles of polyhydric alcohol will be used per mole of dimer acid and preferably from about 2 to about 3 moles of alcohol per mole of acid.

While any of the dimer acids and polyhydric alcohols described above may be used in preparing the friction reducing additive of this invention, the most preferred esters as set forth above are those wherein the carboxyl groups are separated from each other by from about 16 to about 22 carbon atoms and wherein the hydroxy groups are separated from the closest carboxyl group by from about 2 to about 12 carbon atoms. Particularly useful ester additives are obtained when the acid used is a dimer of a fatty acid, preferably those fatty acids containing about 12 to about 22 carbon atoms. Such dimers are, of course, clearly taught in U.S. Pat. No. 3,180,832 which was granted on Apr. 27, 1965 and U.S. Pat. No. 3,429,817 which was granted on Feb. 25, 1969, and as there indicated, the hydrocarbon portion of the dimer carboxylic acid thus obtained may contain a six member ring. The formation of the dimer from linoleic acid, oleic acid and mixtures of these acids is illustrated by the following reactions:

A.

$$CH_3(CH_2)_4CH{=}CHCH_2CH{=}CH(CH_2)_7COOH \xrightleftharpoons[300^\circ\,C.]{\Delta}$$

9, 12 Linoleic Acid $$CH_3(CH_2)_5CH{=}CHCH{=}CH(CH_2)_7COOH \xrightarrow[\text{Diels-Alder}]{\text{2 molecules 9–11 acid}}_{\Delta}$$

9, 11 Linoleic Acid

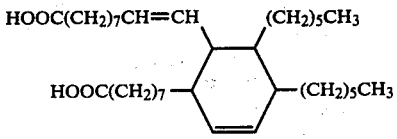

Linoleic Acid Dimer (dilinoleic acid)

B.

$$CH_3(CH_2)_7CH{=}CH(CH_2)_7COOH \xrightarrow[\text{Diels Alder}]{\text{2 molecules oleic acid}}_{\Delta}$$

Oleic Acid $$CH_3(CH_2)_7CH{=}C(CH_2)_7COOH$$
$$\quad\;\; | $$
$$CH_3(CH_2)_7CH_2CH(CH_2)_7COOH$$

Oleic Acid Dimer (Dioleic Acid)

C.

$$\text{9, 11 Linoleic Acid} + \text{Oleic Acid} \xrightarrow[\Delta]{\text{Diels Alder}}$$

$$CH_3(CH_2)_6CHCH{=}CH(CH_2)_7COOH$$
$$\quad\;\; | $$
$$CH_3(CH_2)_4CHCH{=}CHCH{=}CH(CH_2)_7COOH$$

Mixed Dimer

It will, of course, be appreciated that while the reactions illustrated produce the dimers, commercial application of the reactions will, generally, lead to trimer formation and in some cases the product thus obtained will contain minor amounts of unreacted monomer or monomers. As a result, commercially available dimer acids may contain as much as 25% trimer and the use of such mixtures is within the scope of the present invention. It is also noted that prepared dimer acids may be saturated or unsaturated. While in some instances the unsaturated dimer acids are preferred, it is also contemplated that if desired, dimer acids formed having one or more unsaturated bonds may have such unsaturation removed, e.g., by hydrogenation.

The ester friction reducing additive of this invention will generally be used at a concentration of from about 0.01 to about 2.0 parts by weight, preferably from about 0.01 to about 1.0 and more preferably from about 0.05 to about 0.5 parts by weight per 100 parts of lubricating oil composition.

The lubricating base oil will generally comprise a major amount of the lubricating composition, i.e. at least 50% by weight thereof, and will include liquid hydrocarbons such as the mineral lubricating oils and the synthetic lubricating oils and mixtures thereof. The synthetic oils which can be used include diester oils such as di(2-ethylhexyl) sebacate, azelate and adipate; complex ester oils such as those formed from dicarboxylic acids, glycols and either monobasic acids or monhydric alcohols; silicone oils; sulfide esters; organic carbonates; and other synthetic oils known to the art.

Other additives, known in the art, may be added to the oil composition of the present invention to form a finished oil. Such additives include dispersants, antiwear agents, antioxidants, corrosion inhibitors, detergents, pour point depressants, extreme pressure additives, viscosity index improvers, etc. These additives are typically disclosed for example in "Lubricant Additives" by C. V. Smalheer and R. Kennedy Smith, 1967, pp. 1–11 and in U.S. Pat. No. 4,105,571.

The following examples are further illustrative of this invention and are not intended to be construed as limitations thereof.

EXAMPLE 1

A lubricating oil was prepared containing a 150 Solvent Neutral mineral oil and 0.5 parts by weight of an ester additive formed by the esterification of a dimer acid comprising a saturated linoleic and/or oleic dimer acid with glycerol, said dimer acid being sold by Emery Industries, Inc. as Empol 1010.

The prepared composition was tested for relative friction using a ball on cylinder test described in the "Journal of the American Society of Lubrication Engineers" (ASLE Transaction), Vol. 4, pages 1–11, 1961. In essence, the apparatus consists basically of a fixed metal ball loaded against a rotating cylinder. The weight on the ball and the rotation of the cylinder can be varied during any given test or from test to test. Also, the time of any given test can be varied. Generally, however, steel on steel is used at a constant load, constant rpm and a fixed time and in each of the tests of these examples, a 4 kg load, 0.26 rpm and 70 minutes was used. The apparatus and method used is more fully described in U.S. Pat. No. 3,129,580.

The relative friction for this lubricating oil composition described above was 0.10. This compared with a relative friction of 0.30 when the 150 Solvent Neutral mineral oil alone was used.

For comparison purposes, an ester additive comprising a combination of linoleic dimer acid and diethylene glycol was prepared and 0.5 parts by weight of this additive was combined with 150 Solvent Neutral mineral oil. This composition was tested for relative friction as above, and the resulting ball on cylinder friction was 0.16.

EXAMPLE 2

A reference lubricating oil comprising a standard 10W-40SE quality automotive engine oil without friction reducing additive was prepared and placed in the same test apparatus described in Example 1. The apparatus with reference oil was run as described in Example 1 until a stabilized high friction value of about 0.25 was reached.

One drop of a concentrate (50% by weight in toluene) of the reaction product of 2,2',2" nitrilotriethanol with the dimer acid, as described in Example 1 (linoleic and/or oleic dimer acid), was added to the reference oil wearing surface and the test continued for an additional 30 minutes. The relative friction was found to be 0.07.

The same test was carried out using an additive concentrate, the reaction product of 1,2,6 trihydroxyhexane and the dimer acid as described in Example 1. The relative friction after the 30 minute period was 0.07.

For comparison purposes, the same test was carried out using an additive concentrate which comprised the reaction product of linoleic dimer acid and diethylene glycol. The relative friction was found to be 0.09.

For additional comparisons, the same test was carried out using an additive concentrate of (1) the reaction product of polyisiobutylene (M.W. 500) succinic anhydride and glycerol; (2) the reaction product of polyisobutylene (M.W. 1300) succinic anhydride and glycerol and (3) the reaction product of polyisobutylene (M.W. 1300) succinic anhydride and diethylene glycol. The resulting relative friction for each test additive was (1) 0.25, 2) 0.22 and (3) 0.23.

EXAMPLE 3

A standard 10W-40SF quality automotive engine oil was prepared containing 0.2 parts by weight of an additive formed by the esterification of a dimer acid comprising linoleic and/or oleic dimer acid (sold commercially by Emery Industries, Inc. as Empol 1010) and glycerol. This prepared oil composition was tested for relative friction as described in Example 1 and such friction was found to be 0.05.

For comparison purposes, the same standard automotive oil containing 0.2 parts by weight of an additive formed from the combination of linoleic dimer acid and diethylene glycol was tested for relative friction in the same manner. The resulting friction was found to be 0.08 to 0.10 (more than one run).

For additional comparison purposes, the same standard automotive oil containing 0.2 parts by weight of an additive comprising a mixture of mono (55%) and diglyceride of oleic acid (i.e. glycerol monooleate and glycerol dioleate) was prepared and tested in the same manner. The relative friction was found to be 0.22 to 0.24 (more than one run).

The data disclosed in the above three examples shows the significant unexpected friction reduction which results when using the friction reducing additive of this invention particularly when compared to other known additives which have similar but different structures. Thus, the ester additive of linoleic dimer acid and diethylene glycol of the type shown in U.S. Pat. No. 4,105,571 (Examples 1, 2 and 3) and the esters of monocarboxylic acid and glycerol of the type shown in U.S. Pat. No. 4,304,678 and U.K. Pat. Nos. 2,038,355 and 2,038,356 (Example 3) are shown to have significantly less effect in reducing friction than the selected additives of this invention.

What is claimed is:

1. A method of reducing friction in an internal combustion engine comprising lubricating said engine using a lubricating oil composition containing from about 0.01 to about 2.0 parts by weight of an additive which is the reaction product of a dimer carboxylic acid having about 24 to about 90 carbon atoms and a polyhydric alcohol having at least three hydroxyl groups and about 3 to about 18 carbon atoms, all weights based on 100 parts by weight of lubricating oil composition.

2. The method of claim 1 wherein said dimer carboxylic acid contains about 9 to about 42 carbon atoms between carboxylic acid groups and said reaction product is formed using from about 1 to about 3 moles of alcohol per mole of dimer acid.

3. The method of claim 2 wherein said polyhydric alcohol has 3 hydroxyl groups.

4. The method of claim 3 wherein from about 0.01 to about 1.0 parts by weight of said reaction product is used and said carboxylic acid is a fatty acid which contains about 12 to about 22 carbon atoms.

5. The method of claim 4 wherein said alcohol is selected from the group consisting of glycerol, 1,2,6 trihydroxyhexane and 2,2',2" nitrilotriethanol.

6. The method of claim 5 wherein said dimer carboxylic acid is the dimer of linoleic acid, oleic acid or mixtures thereof.

7. The method of claim 2 wherein said dimer carboxylic acid has about 24 to about 60 carbon atoms and said polyhydric alcohol has about 3 to about 12 carbon atoms.

8. The method of claim 7 wherein from about 0.01 to about 1.0 parts by weight of said reaction product is used and said carboxylic acid is a fatty acid which contains about 12 to about 22 carbon atoms.

9. The method of claim 8 wherein said polyhydric alcohol has 3 hydroxyl groups.

10. The method of claim 9 wherein said alcohol is selected from the group consisting of glycerol, 1,2,6 trihydroxyhexane and 2,2',2" nitrilotriethanol.

11. The method of claim 10 wherein from about 0.05 to about 0.5 parts by weight of said reaction product is used and said dimer carboxylic acid is the dimer of linoleic acid, oleic acid or mixtures thereof.

* * * * *